US010470600B2

(12) United States Patent
Warren et al.

(10) Patent No.: US 10,470,600 B2
(45) Date of Patent: Nov. 12, 2019

(54) GARMENT HANGER USED WITH DUAL SIZERS

(71) Applicant: BRAIFORM (HK) LTD., Kwun Tong (HK)

(72) Inventors: Michael Warren, Bishops Stortford (GB); Andrew Zuckerman, New York, NY (US)

(73) Assignee: BRAIFORM (HK) LTD., Kwun Tong (HK)

( * ) Notice: Subject to any disclaimer, the term of this patent is extended or adjusted under 35 U.S.C. 154(b) by 127 days.

(21) Appl. No.: 15/714,520

(22) Filed: Sep. 25, 2017

(65) Prior Publication Data

US 2019/0090675 A1 Mar. 28, 2019

(51) Int. Cl.
*A47G 25/14* (2006.01)

(52) U.S. Cl.
CPC ..... *A47G 25/1407* (2013.01); *A47G 25/1435* (2013.01)

(58) Field of Classification Search
CPC ..... A47G 25/14; A47G 25/1407; A47G 25/1414; A47G 25/1421; A47G 25/1428; A47G 25/1435
See application file for complete search history.

(56) References Cited

U.S. PATENT DOCUMENTS

| | | | | |
|---|---|---|---|---|
| 5,775,553 | A * | 7/1998 | Marshall | A47G 25/1421 223/85 |
| 6,264,075 | B1 | 7/2001 | Gouldson et al. | |
| 6,564,980 | B2 | 5/2003 | Gouldson et al. | |
| 6,932,251 | B2 * | 8/2005 | Kolton | A47G 25/1435 223/85 |
| 6,948,269 | B2 * | 9/2005 | Wang | A47G 25/1435 223/85 |
| 7,380,359 | B2 * | 6/2008 | Mainetti | G09F 3/02 223/85 |
| 7,516,875 | B2 | 4/2009 | Gouldson | |
| 7,841,495 | B2 * | 11/2010 | Gouldson | A47G 25/1414 223/85 |
| 7,922,047 | B2 | 4/2011 | Gouldson | |
| 8,286,841 | B2 * | 10/2012 | Louw | A47G 25/1435 223/85 |
| 2007/0278259 | A1 * | 12/2007 | Wong | A47G 25/1435 223/85 |
| 2010/0019002 | A1 * | 1/2010 | Gouldson | A47G 25/1428 223/85 |

* cited by examiner

*Primary Examiner* — Ismael Izaguirre
(74) *Attorney, Agent, or Firm* — Scully Scott Murphy and Presser

(57) ABSTRACT

A combination of a reusable garment hanger and an indicator for displaying garment-related information is provided. The hanger has an indicator attachment mechanism, which is configured to selectively engage, in a detachable manner, a first indicator or a second indicator that has a dimension different from the dimension of the first indicator. The hanger can be used and reused with different indicators.

24 Claims, 13 Drawing Sheets

GARMENT HANGER USED WITH DUAL SIZERS

BACKGROUND OF THE INVENTION

The present disclosure relates generally to molded plastic garment hangers as are widely used for the purpose of shipping and displaying garments. More specifically, the present disclosure relates to a garment hanger, which can be selectively used and reused with two different garment size indicators to provide a versatile garment hanger. As a result, the garment hanger can be reused to save materials, and thus, is environmentally advantageous.

In the area of retail garment sales, so-called Garment-On-Hanger (GOH) programs have become preferred by retailers. In a GOH program, garments are delivered to retail merchants already suspended from hangers, where upon arrival at the retail location the garments are immediately placed on display for sale.

In particular, retailers have specified particular hangers or hanger characteristics among suppliers in order to achieve uniformity on their sales floors. To this end, standards as to hanger size, shape, performance characteristics, etc., are maintained, for example, by organizations such as the Voluntary Inter-industry Commerce Standards Association (VICS). Intimate apparel hangers, pinch grip hangers, top garment hangers and so on are among the standardized hangers under the VICS standards.

Additionally, and interrelated to the promulgation of GOH programs, retailers and their customers desire to have the hanger itself display some indicia regarding the item carried upon it. Categories of indicia include origin of manufacturer, materials of the garments and prices of the garments, but mostly the sizes of garments. Among the various means developed for accomplishing this, so-called lower neck size indicators are widely applied and recognized in the industry. Lower neck size indicators are secured to the hanger at or adjacent the intersection of the hook and the hanger body, to provide a displaying surface on which garment sizes are printed.

Typically, a type of hanger is designed only to be usable with a specific type of size indicator. With the increasing need to display more information related to garments, more types of size indicators have been designed, which in turn requires more types of hangers to be molded. As known in the hanger-molding industry, whenever a new mold is created for making hangers, significant cost associated with designing, testing and revising the mold will be incurred. Thus, it is desirable in the industry to provide a versatile hanger, which can be used and reused with different size indicators to save material and cost of manufacture.

SUMMARY OF THE INVENTION

According to an exemplary aspect of the present disclosure, a garment hanger is provided. The hanger includes a body and a hook extending upright from the body. The intersection of the body and the hook defines a lower neck region of the garment hanger. The hanger further includes a sizer attachment mechanism provided at a side of the lower neck region. The sizer attachment mechanism is configured to engage a sizer for selectively attaching and detaching the sizer with respect to the hanger. The sizer attachment mechanism includes a first web having a first surface and an opposite second surface. The first web includes at least one fixed latch formed on the first surface of the first web, and a pivotable latch pivotable with respect to the at least one fixed latch through a hinge. The sizer attachment mechanism further includes a second web connected to the first web and a rib connected to the second web. The rib extends angularly between the body and the hook. The sizer attachment mechanism also includes a void in the sizer attachment mechanism to provide a discontinuity in the second web and the rib.

According to an exemplary aspect of the present disclosure, a sizer is provided. The sizer includes a front wall having a top edge and a bottom edge. The sizer further includes a rear wall opposite the front wall. The rear wall has a top edge and a bottom edge. Both the front wall and the rear wall are substantially trapezoidal. The sizer further includes a bottom wall connecting the bottom edge of the front wall with the bottom edge of the rear wall. Additionally, the sizer includes a first inwardly extending protrusion provided at the top edge of the front wall and a second inwardly extending protrusion provided at the top edge of the rear wall.

According to an exemplary aspect of the present disclosure, a combination of a garment hanger and a sizer is provided. The garment hanger includes a body and a hook extending upright from the body. The intersection of the body and the hook defines a lower neck region of the garment hanger. The hanger further includes a sizer attachment mechanism provided at a side of the lower neck region. The sizer attachment mechanism is configured to engage the sizer for selectively attaching and detaching the sizer with respect to the hanger. The sizer attachment mechanism includes a first web having a first surface and an opposite second surface. The first web includes at least one fixed latch formed on the first surface of the first web, and a pivotable latch pivotable with respect to the at least one fixed latch through a hinge. The sizer attachment mechanism further includes a second web connected to the first web and a rib connected to the second web. The rib extends angularly between the body and the hook. The sizer attachment mechanism further includes a void for providing a discontinuity in the second web and the rib.

The sizer includes a front wall having a top edge and a bottom edge. The sizer further includes a rear wall opposite the front wall. The rear wall has a top edge and a bottom edge. Both the front wall and the rear wall are substantially trapezoidal. The sizer also includes a bottom wall connecting the bottom edge of the front wall with the bottom edge of the rear wall. Additionally, the sizer includes a first inwardly extending protrusion provided at the top edge of the front wall and a second inwardly extending protrusion provided at the top edge of the rear wall. When the sizer is being attached to the hanger, the first inwardly extending protrusion is engageable with the at least one fixed latch and the second inwardly extending protrusion is engageable with the pivotable latch to implement a secured attachment of the sizer to the hanger. When the sizer is not attached to the hanger, the void allows a secondary sizer to be removably engageable with the first web of the sizer attachment mechanism to attach the secondary sizer to the hanger.

According to yet an exemplary aspect of the present disclosure, a method of using a hanger with a first sizer and reusing the hanger with a second sizer is provided. The first sizer has a dimension that is different from a dimension of the second sizer. The method includes attaching the first sizer to a sizer attachment mechanism of the hanger. The sizer attachment mechanism includes a first web having a first surface and an opposite second surface. The first web includes at least one fixed latch formed on the first surface of the first web and a pivotable latch pivotable with respect to the at least one fixed latch through a hinge. The sizer attachment mechanism further includes a second web connected to the first web and a rib connected to the second web. The rib extends angularly between a body and a hook of the hanger. The sizer attachment mechanism also includes a void in the sizer attachment mechanism to provide a discontinuity in the second web and the rib. The attaching the first sizer to the sizer attachment mechanism includes engaging the first sizer with both the at least one fixed latch and the pivotable latch and at least partially positioning the first sizer in the void. The method further includes detaching the first sizer from the sizer attachment mechanism. The method also includes attaching the second sizer to the sizer attachment mechanism. The attaching the second sizer to the sizer attachment mechanism includes engaging the second sizer with both the at least one fixed latch and the pivotable latch and covering the void with the second sizer.

According to still another exemplary aspect of the present disclosure, a garment hanger is provided. The hanger includes a body and a hook extending upright from the body. The intersection of the body and the hook defines a lower neck region of the garment hanger. The hanger further includes a sizer attachment mechanism provided at a side of the lower neck region. The sizer attachment mechanism is configured to engage a sizer for attaching the sizer to the hanger in an un-detachable manner. The sizer attachment mechanism includes a first web having a first surface and an opposite second surface. The first web includes at least one fixed latch formed on the first surface of the first web, and a pivotable latch pivotable with respect to the at least one fixed latch through a hinge. The sizer attachment mechanism further includes a second web connected to the first web and a rib connected to the second web. The rib extends angularly between the body and the hook. The sizer attachment mechanism also includes a void in the sizer attachment mechanism to provide a discontinuity in the second web and the rib.

According to another exemplary aspect of the present disclosure, a garment hanger is provided. The hanger includes a body and a hook extending upright from the body. The intersection of the body and the hook defines a lower neck region of the garment hanger. The hanger further includes a sizer attachment mechanism provided at a side of the lower neck region. The sizer attachment mechanism is configured to alternatively engage a first sizer or a second sizer for attaching the first or second sizer to the hanger in an un-detachable manner. The first sizer and the second sizer have different dimensions. The sizer attachment mechanism includes a first web having a first surface and an opposite second surface. The first web includes a first fixed latch formed on the first surface of the first web and a second fixed latch formed on the second surface of the first web. The sizer attachment mechanism further includes a second web connected to the first web and a rib connected to the second web. The rib extends angularly between the body and the hook. A void is provided in the sizer attachment mechanism to provide a discontinuity in the second web and the rib.

According to another aspect of the present disclosure, a method of using a hanger selectively with a first sizer and a second sizer. The first sizer has a dimension that is different from a dimension of the second sizer. A sizer from the first sizer and the second sizer is selected to be attached to the hanger. The selected sizer is attached to a sizer attachment mechanism of the hanger. The sizer attachment mechanism includes a first web having a first surface and an opposite second surface. The first web includes a first fixed latch formed on the first surface of the first web and a second fixed latch formed on the second surface of the first web. The sizer attachment mechanism further includes a second web connected to the first web and a rib connected to the second web. The rib extends angularly between a body and a hook of the hanger. A void is provided in the sizer attachment mechanism to provide a discontinuity in the second web and the rib. The attaching the selected sizer to the sizer attachment mechanism of the hanger includes engaging the selected sizer with both the first fixed latch and the second fixed latch in a un-detachable manner.

DETAILED DESCRIPTION

Although this invention is applicable to numerous and various types of hangers, it has been found particularly useful in the environment of garment hangers having a hook for suspending the garment hanger from a display. Therefore, without limiting the applicability of the invention to these types of hangers, the invention will be described in such environment.

Figure 1:
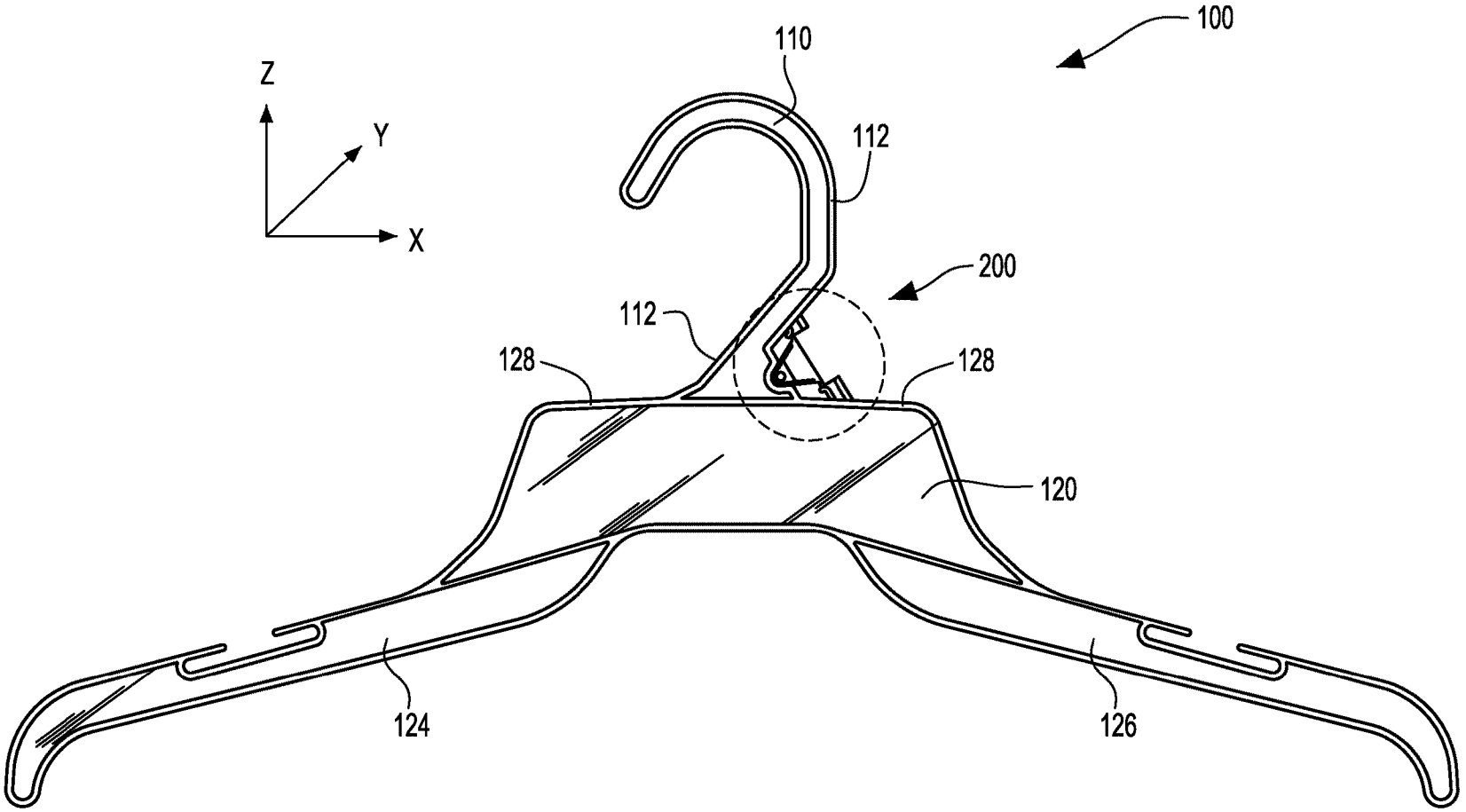
FIG. 1 is a front elevation view of a garment hanger according to an exemplary embodiment of the present disclosure.

FIG. 1 depicts a garment hanger 100 according to an exemplary embodiment of the present disclosure. The hanger 100 can be a molded plastic top garment hanger. The garment hanger 100 includes a hook 110, through which the hanger 100 can be supported on a display, such as, a rack or a rod. The hook 110 includes a continuous flange 112. The hanger 100 further includes a hanger body 120, to which the hook 110 is uprightly connected. The body 120 is generally planar and includes a pair of arms 124, 126 extending opposite to one another. The hanger body 120 can have any suitable configuration, such as a C-section beam, a reversed U-section beam, I-section beam and the like. The hanger body 120 includes a top flange 128, which is connected to the continuous flange 112 of the hook 110.

In FIG. 1, a three-dimensional coordinate system is defined as shown. The vertical part of the hook 110 extends upwardly from the hanger body 120, substantially along the vertical Z-axis of the coordinate system. The hanger arms 124 and 126 extend substantially along the horizontal X-axis of the coordinate system to define a length of the hanger body 120. Furthermore, a transverse direction is defined along the Y-axis of the coordinate system.

Figure 2A:
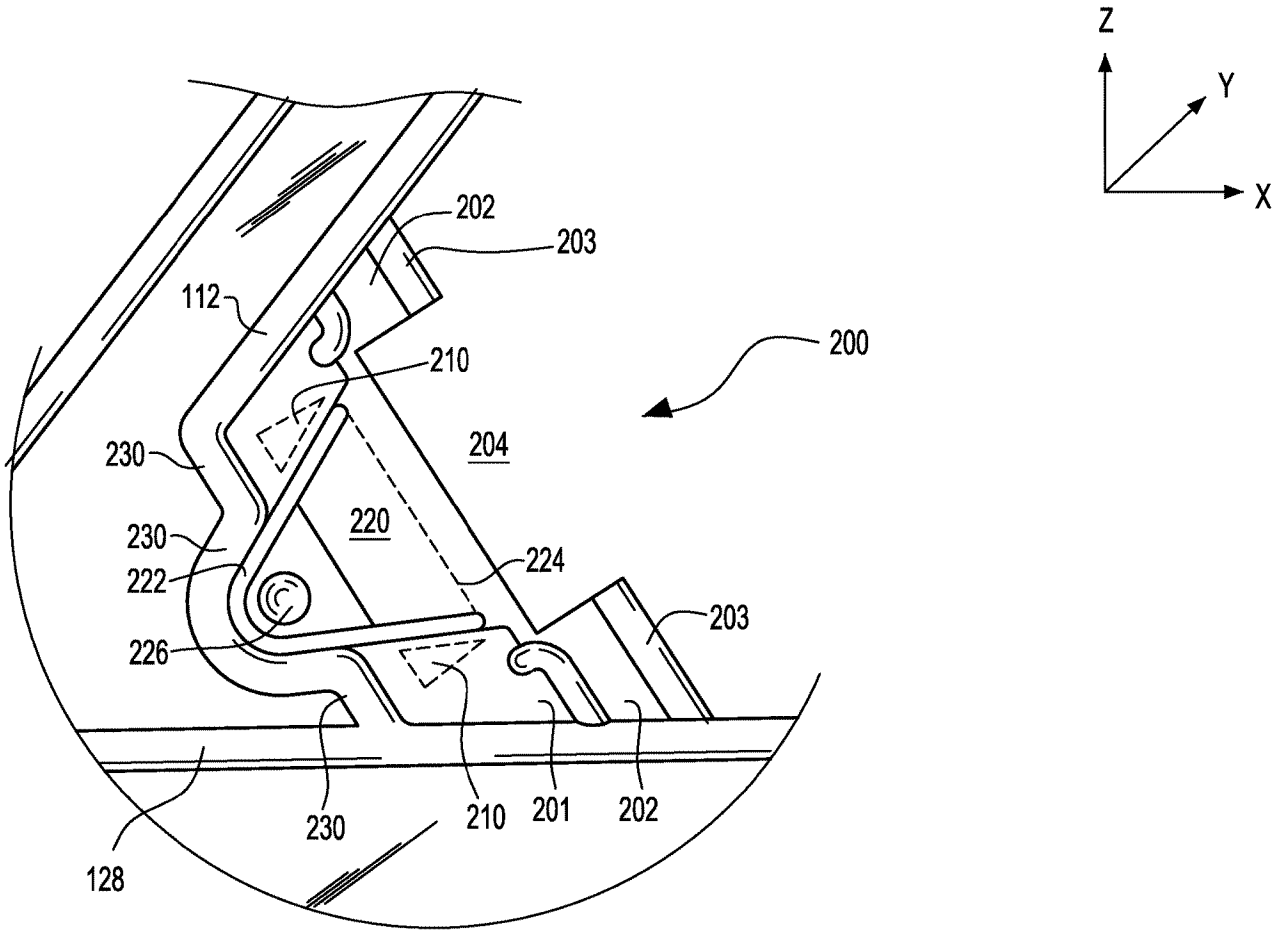
FIG. 2A is an enlarged view of a lower neck region of the garment hanger of FIG. 1, showing an embodiment of a sizer engagement mechanism of the garment hanger.
Figure 4:
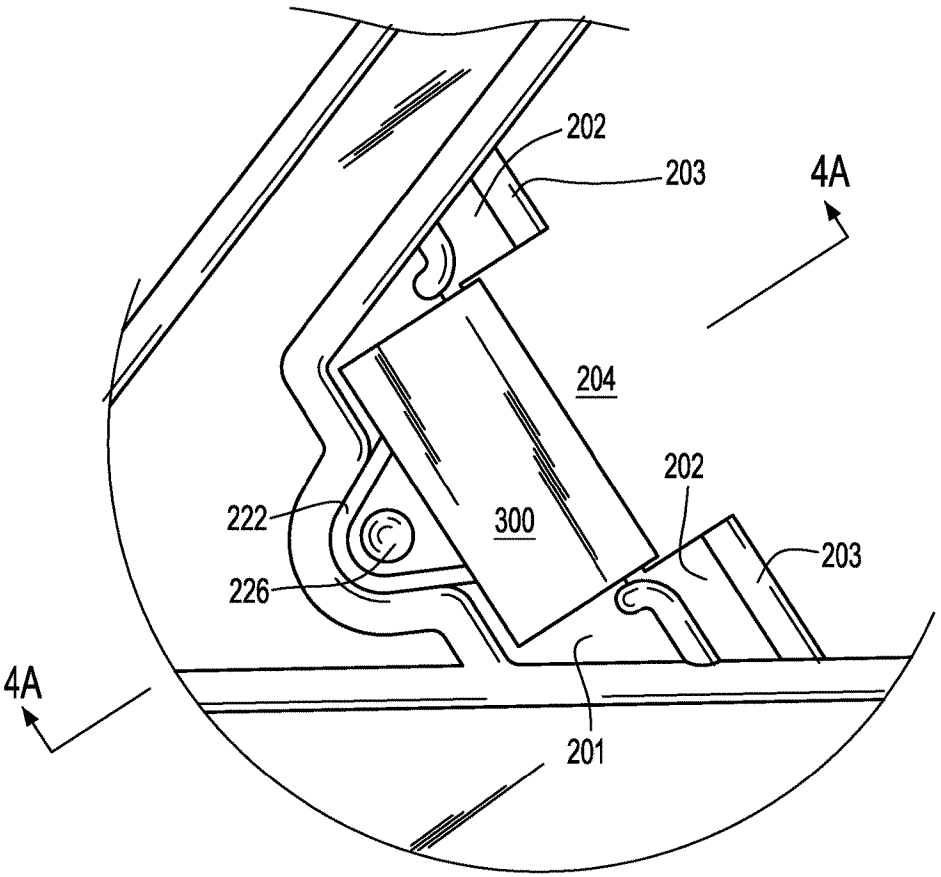
FIG. 4 is an enlarged view of a lower neck region of the hanger-sizer combination of FIG. 3.
Figure 4A:
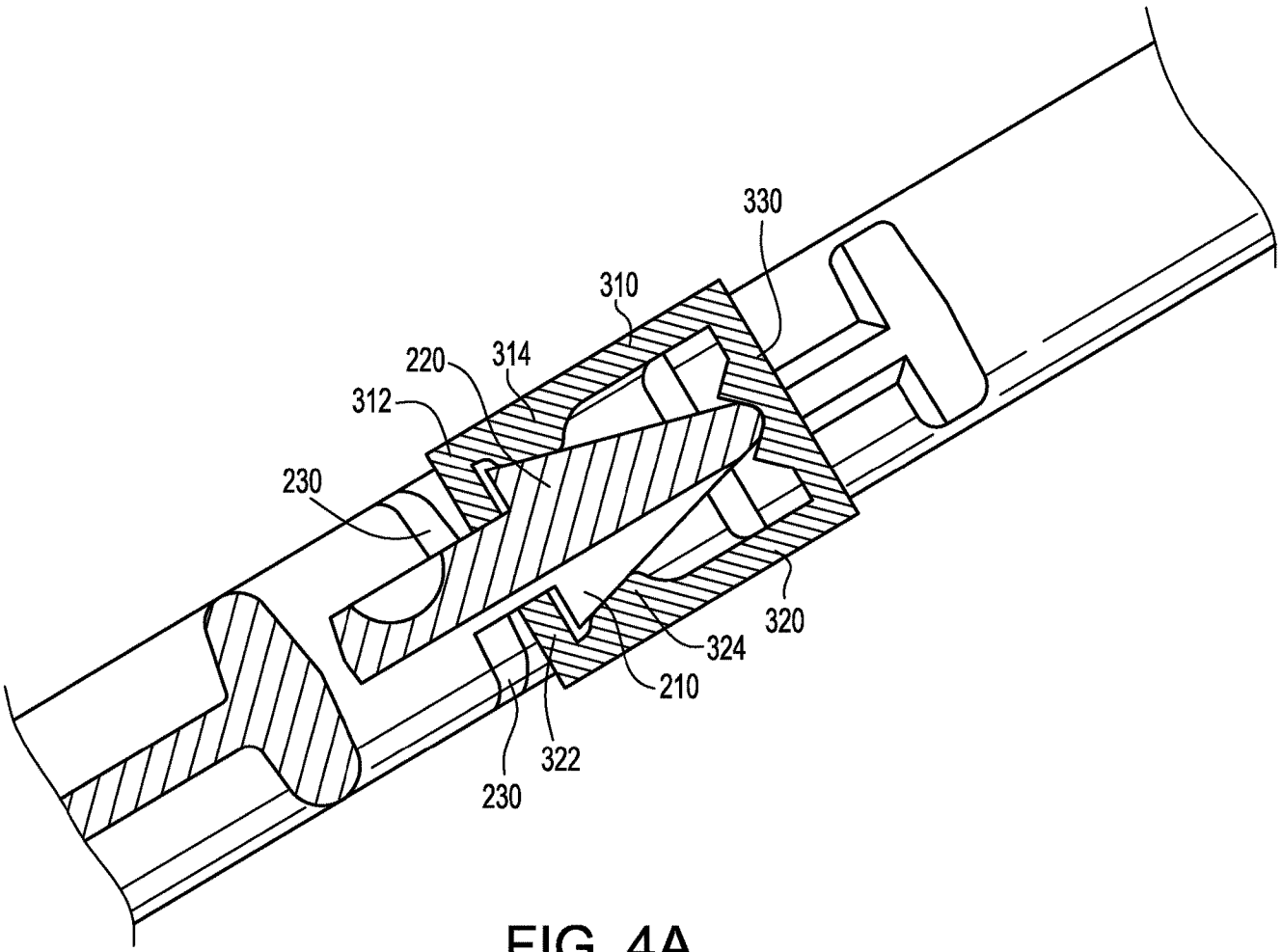
FIG. 4A is a sectional view along lines 4A-4A of FIG. 4, showing the structure of the first sizer and the engagement between the first sizer and the hanger.

At a side of the junction of the hook 110 and the body 120, a sizer engagement mechanism 200 is provided for removably and selectively securing two different sizers to the hanger 100. The detailed implementation of the sizer attachment mechanism 200 is depicted in FIG. 2A. The sizer engagement mechanism 200 includes a first web 201, which has a front surface and an opposite rear surface (not shown). The first web 201 includes at least one fixed latch 210 provided at the rear surface of the first web 201, although two fixed latches are shown in the embodiment. The first web further includes a pivotable latch 220, which can be provided at a central portion of the first web 201. The pivotable latch 220 is configured to slightly project from the front surface of the first web 201. The fixed latch 210 is configured to slightly project from the rear surface of the first web 201 (as shown in FIG. 4A).

The pivotable latch 220 is defined by a continuous slot 222, which is formed through the first web 201 from the front surface thereof to the rear surface thereof. The pivotable latch 220 is further defined by a living hinge 224. The continuous slot 222 and the living hinge 224 together define a substantially triangular shape of the pivotable latch 220 as shown in the embodiment and allow the pivotable latch 220 to pivot with respect to the living hinge 224 when a force is applied to the pivotable latch 220. The pivotable latch and the slot defining the shape thereof, can have any shape, such as rectangular, without departing from the scope or spirit of the present disclosure.

Figure 6:
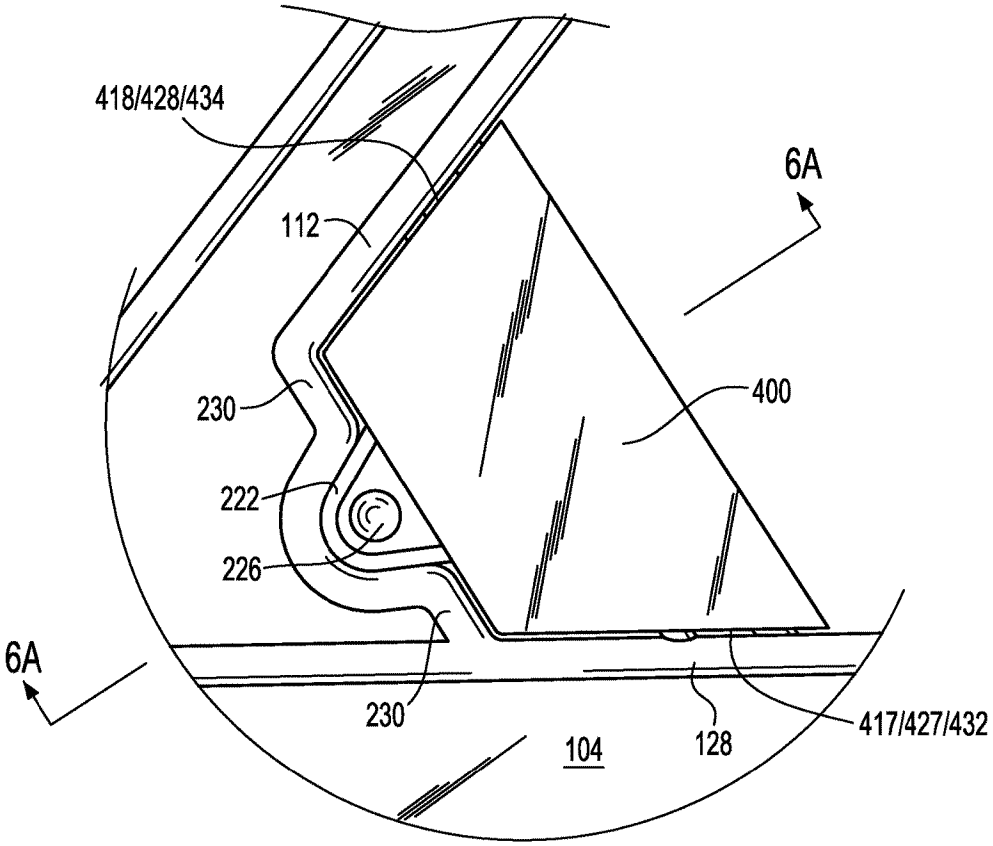
FIG. 6 is an enlarged view of a lower neck region of the hanger-sizer combination of FIG. 5.
Figure 6A:
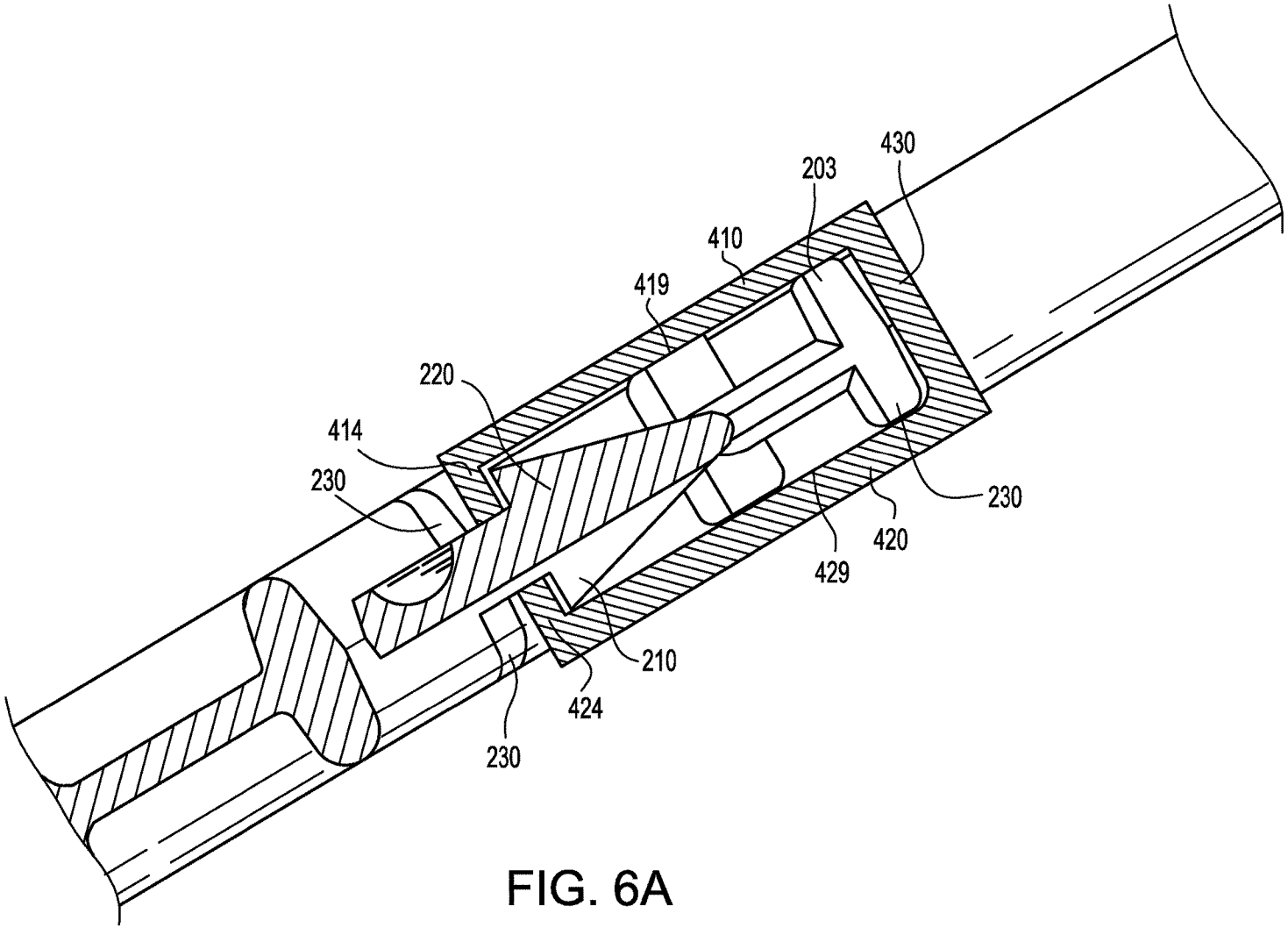
FIG. 6A is a sectional view along lines 6A-6A of FIG. 6, showing the structure of the second sizer and the engagement between the second sizer and the hanger.

A dimple 226 is provided at the tip of the pivotable latch 220. The dimple 226 is configured to engage a tool that is used to apply a releasing force to remove a sizer from the sizer attachment mechanism 200. The sizer attachment mechanism 200 further includes a guard 230 formed at the front side of the hanger 100, as shown in FIG. 2A. The guard 230 is connected to the flange 112 of the hook 110, at the top end of the guard 230. The guard 230 is connected to the top flange 128 of the hanger body 120, at the bottom end of the guard 230. The guard 230 prevents inadvertent actuation of the pivotable latch 220 by applying a sizer-releasing force to the dimple 226. Optionally, an additional guard can be formed at the rear side of the hanger 100 (as shown in FIGS. 4A and 6A).

The sizer attachment mechanism 200 further includes a second web 202 and a rib 203 continuous with the second web 202, as shown in FIG. 2A. The rib 203 extends angularly between a top flange of the hanger body 120 and the hanger hook 110, at the side of the lower neck region of the hanger 100. The rib 203 also extends transversely from the second web 202. Both the second web 202 and the angularly extending rib 203 are discontinued by a void 204 in the shape of a substantial rectangle. The provision of the void 204 allows a first sizer (which is smaller) to be secured to the first web 201 and partially positioned in the void 204. In addition, the void 204 allows a second sizer (which is larger) to be secured to the first web 201, and also engaged with the angularly extending rib 203 while covering the void 204.

Figure 2B:
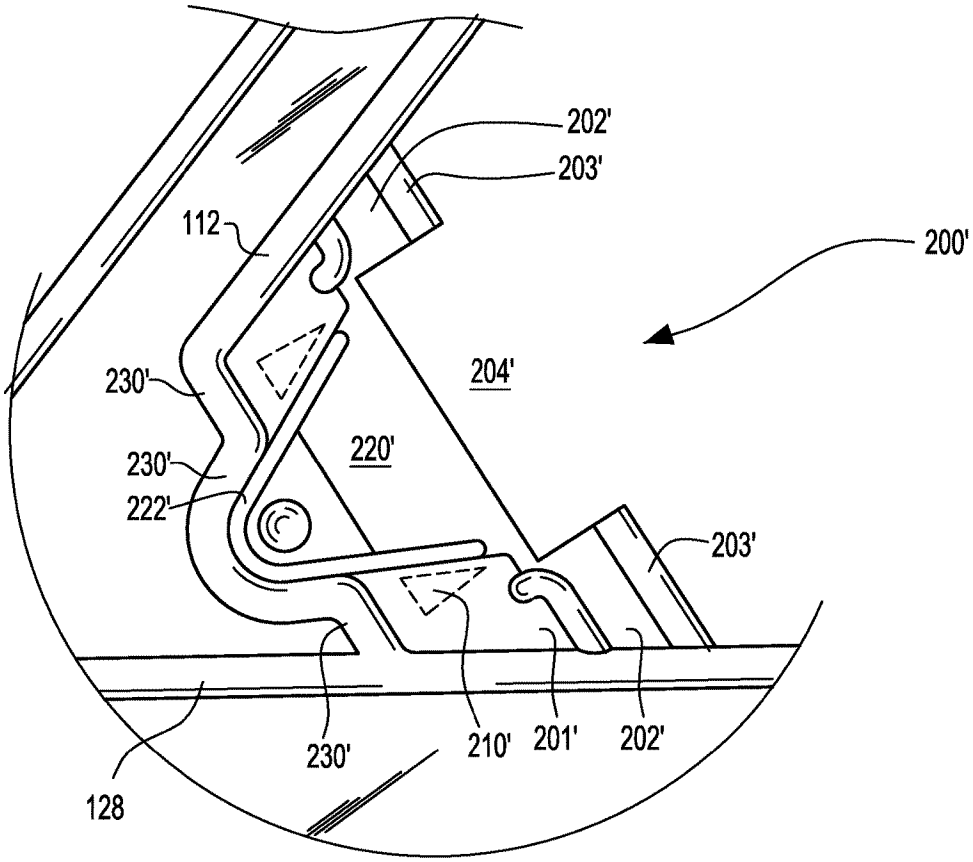
FIG. 2B is an enlarged view of a lower neck region of the garment hanger of FIG. 1, showing another embodiment of the sizer engagement mechanism of the garment hanger.

FIG. 2B depicts a sizer engagement mechanism 200' according to another embodiment of the present disclosure. The sizer engagement mechanism 200' is provided for selectively securing two different sizers to the hanger 100. The sizer engagement mechanism 200' includes a first web 201', which has a front surface and an opposite rear surface (not shown). The first web 201' includes at least one fixed latch 210' provided at the rear surface of the first web 201', although two fixed latches are shown in the embodiment. The first web further includes a pivotable latch 220', which can be provided at a central portion of the first web 201'. The pivotable latch 220' is configured to slightly project from the front surface of the first web 201'. The fixed latch 210' is configured to slightly project from the rear surface of the first web 201' (not shown).

The pivotable latch 220' is defined by a continuous slot 222', which is formed through the first web 201' from the front surface thereof to the rear surface thereof. The pivotable latch 220' is slightly pivotable with respect to the fixed latch 210', through the resilience of the material for forming the pivotable latch 220'. The pivotable latch 220' can have a substantially triangular shape. However, other suitable shapes, such as rectangular, can be provided without departing from the scope or spirit of the present disclosure. In addition, the sizer engagement mechanism 200', according to this embodiment, is different from the sizer engagement mechanism 200, in that there is no dimple formed at the tip of the pivotable latch 220'. As such, the sizer engagement mechanism 200', according to this embodiment, does not allow removal of a sizer, once the sizer is securely attached to the sizer engagement mechanism. Accordingly, the hanger, which includes the sizer engagement mechanism 200', provides a non-removal option for users.

The sizer attachment mechanism 200' further includes a second web 202' and a rib 203' continuous with the second web 202', as shown in FIG. 2B. The rib 203' extends angularly between the top flange 128 of the hanger body 120 and the first flange 112 of the hanger hook 110, at the side of the lower neck region of the hanger 100. The rib 203' also extends transversely from the second web 202'. Both the second web 202' and the angularly extending rib 203' are discontinued by a void 204' in the shape of a substantial rectangle. The provision of the void 204' allows a first sizer (which is smaller) to be secured to the first web 201' and partially positioned in the void 204'. In addition, the void 204' allows the first sizer to be removed from the first web 201' and subsequently, a second sizer (which is larger) to be secured to the first web 201', while at least partially covering the void 204'.

Figure 2C:
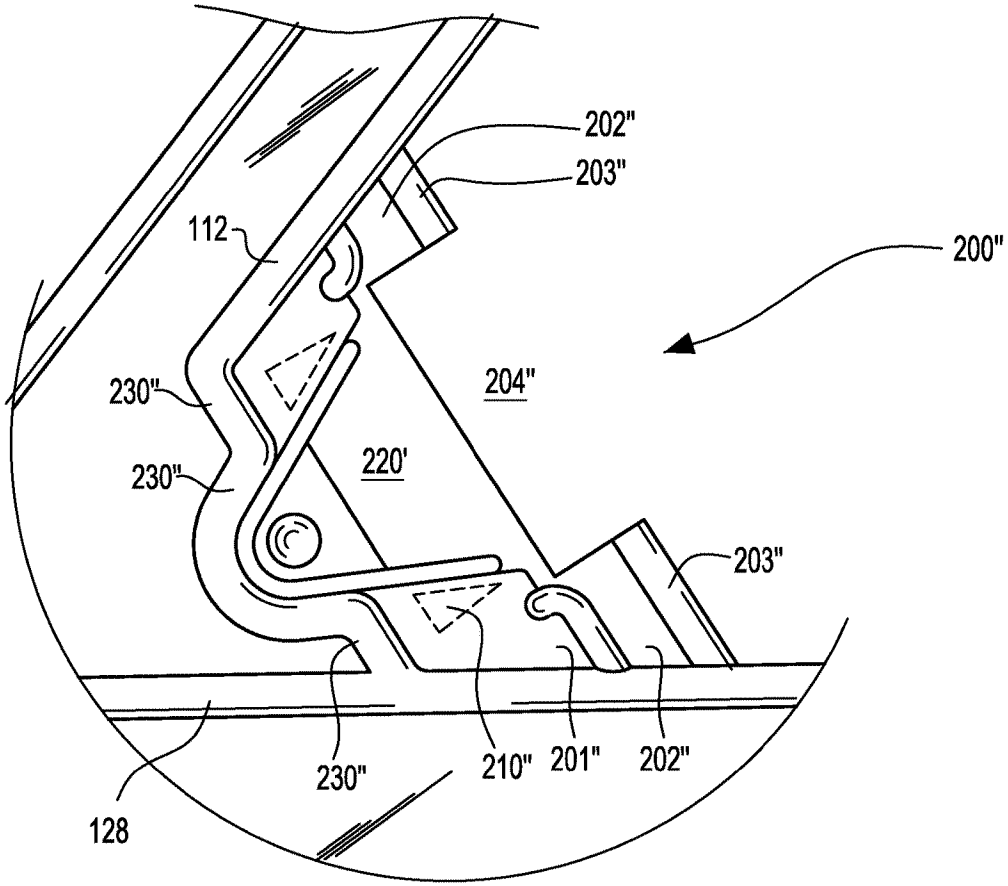
FIG. 2C is an enlarged view of a lower neck region of the garment hanger of FIG. 1, showing yet another embodiment of the sizer engagement mechanism of the garment hanger.

FIG. 2C depicts a sizer engagement mechanism 200" according to yet another embodiment of the present disclosure. The sizer engagement mechanism 200" is provided for selectively securing two different sizers to the hanger 100. The sizer engagement mechanism 200" includes a first web 201", which has a front surface and an opposite rear surface (not shown). The first web 201" includes at least one rear fixed latch 210" provided at the rear surface of the first web 201", although two fixed latches are shown in the embodiment. The first web further includes at least one front fixed latch 220", which can be provided at a central portion of the first web 201". The front fixed latch 220" is configured to slope from the front surface of the first web 201". The fixed latch 210" is configured to slope from the rear surface of the first web 201" (not shown). The sizer engagement mechanism 200", according to this embodiment, is different from the sizer engagement mechanism 200, in that there is no continuous slot or dimple formed. As such, the sizer engagement mechanism 200", according to this embodiment, does not allow removal of a sizer, once the sizer is securely attached to the sizer engagement mechanism. Accordingly, the hanger, which includes the sizer engagement mechanism 200", provides a non-removal option for users.

The sizer attachment mechanism 200" further includes a second web 202" and a rib 203" continuous with the second web 202", as shown in FIG. 2C. The rib 203" extends angularly between the top flange 128 of the hanger body 120 and the first flange 112 of the hanger hook 110, at the side of the lower neck region of the hanger 100. The rib 203" also extends transversely from the second web 202". Both the second web 202" and the angularly extending rib 203" are discontinued by a void 204" in the shape of a substantial rectangle. The provision of the void 204" allows a first sizer (which is smaller) to be secured to the first web 201" and partially positioned in the void 204". In addition, the void 204" allows the first sizer to be removed from the first web 201" and subsequently, a second sizer (which is larger) to be secured to the first web 201", while at least partially covering the void 204".

Figure 3:
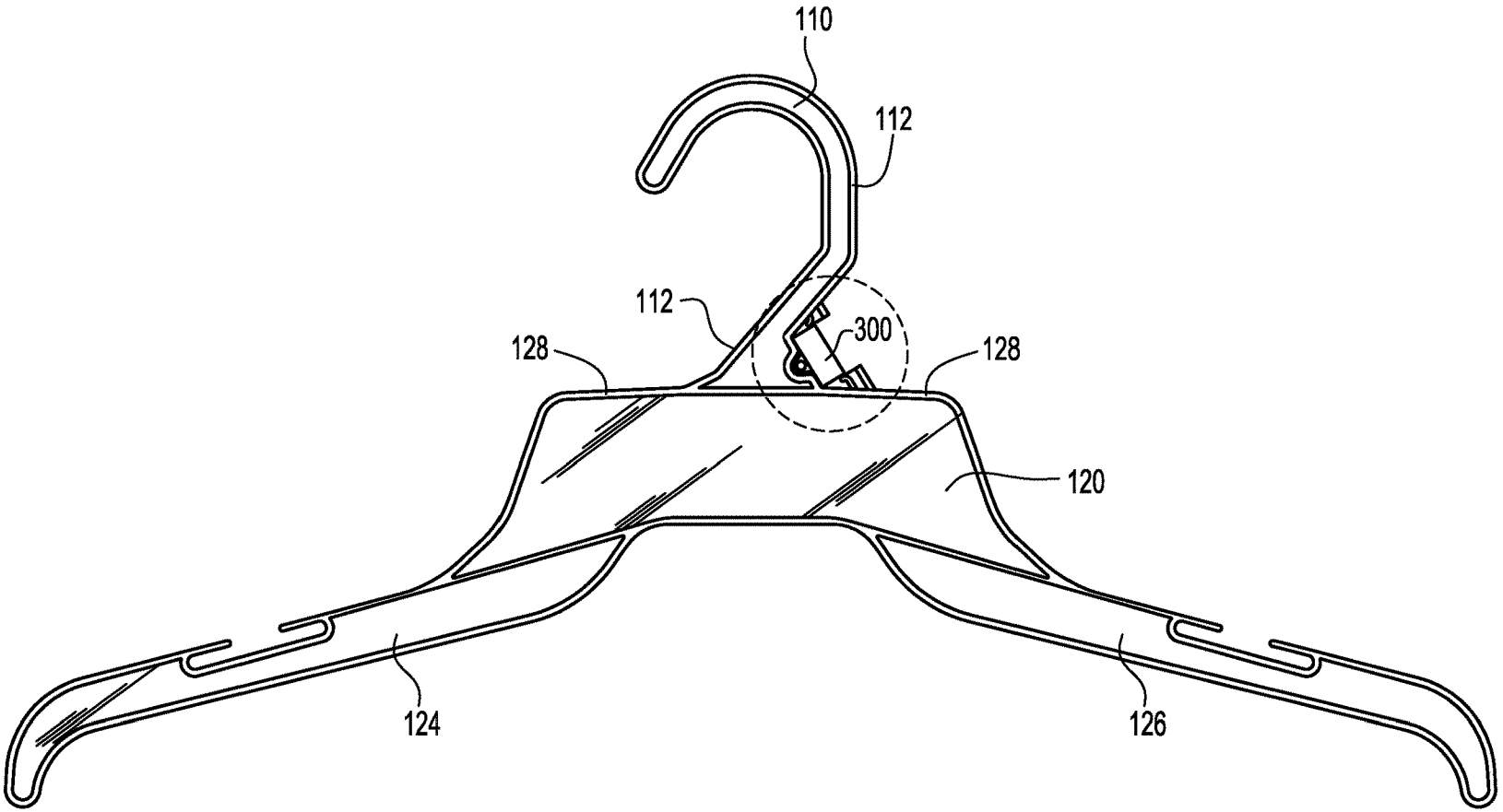
FIG. 3 is a front elevation view of the garment hanger of FIG. 1 in combination with a first sizer, according to another exemplary embodiment of the present disclosure.

FIG. 3 depicts a combination of the hanger 100 (having the sizer attachment mechanism 200) with a first sizer 300 when the sizer 300 is attached to the hanger 100. FIG. 4 is an enlarged view of the lower neck region of FIG. 3. As shown in FIG. 4, the first sizer 300 is secured to the first web 201 by engaging both the fixed latches 210 and the pivotable latch 220, after the first sizer 300 passes the void 204 and is partially positioned in the void 204. The first sizer 300 can be detached from the first web 201 by applying a releasing force to the dimple 226.

Figure 4B:
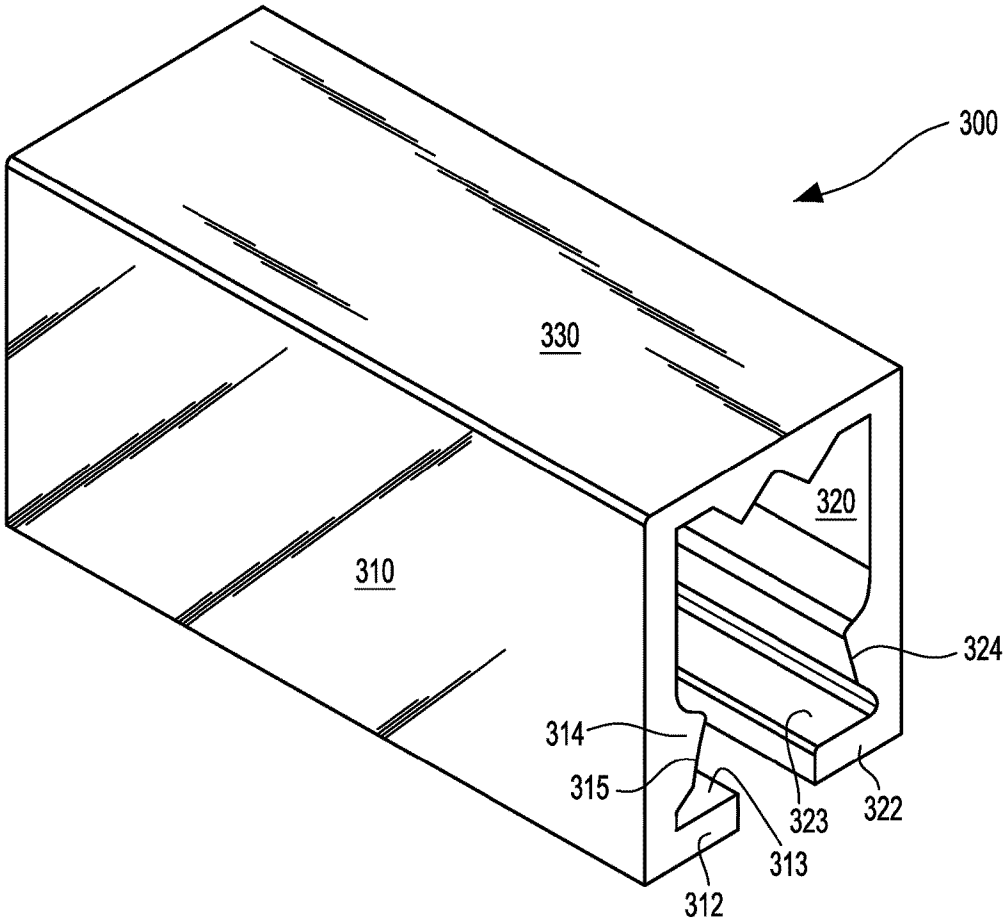
FIG. 4B is a perspective view of the first sizer.

FIG. 4A depicts a sectional view of the combination of the first sizer 300 and the hanger 100, along lines 4A-4A of FIG. 4. FIG. 4B depicts a perspective view of the first sizer 300.

As shown in FIGS. 4A and 4B, the first sizer 300 includes a first side panel 310, a second side panel 320 and a middle panel 330 connecting the first side panel 310 and the second side panel 320. The first panel 310 and the second panel 320 can be substantially parallel to each other. The middle panel 330 can be substantially perpendicular to the first panel 310 and the second panel 320. The first side panel 310, the second side panel 320 and the middle panel 330 together define a receiving space, which operatively admits the fixed latches 210 and the pivotable latch 220 of the sizer attachment mechanism 200 of the hanger 100 when the first sizer 300 is being attached to the hanger 100.

At the side of the first side panel 310, the first sizer 300 includes a first inwardly extending finger 312 provided at an end of the first side wall 310 opposite the middle panel 330. For example, the first inwardly extending finger 312 can be substantially perpendicular to the first side panel 310. At the same side, the first sizer 300 further includes a first inwardly sloped projection 314. The first side panel 310, the first inwardly extending finger 312 and the first inwardly sloped projection 314 can be formed (such as, molded) integrally. The first inwardly extending finger 312 has an inner surface 313. The first inwardly sloped projection 314 has a first sloped surface 315. As shown in FIG. 4A, once the first sizer 300 is attached to the hanger 100, the inner surface 313 of the first inwardly extending finger 312 is capable of engaging the side surface of the pivotable latch 220 and the first sloped surface 315 of the first inwardly sloped projection 314 is capable of engaging the sloped surface of the pivotable latch 220.

At the side of the second side panel 320, the first sizer 300 includes a second inwardly extending finger 322 provided at an end of the second side wall 320 opposite the middle panel 330. For example, the second inwardly extending finger 322 can be substantially perpendicular to the second side panel 320. At the same side, the first sizer 300 further includes a second inwardly sloped projection 324. The second side panel 320, the second inwardly extending finger 322 and the second inwardly sloped projection 324 can be formed (such as, molded) integrally. The second inwardly extending finger 322 has an inner surface 323. The second inwardly sloped projection 324 has a second sloped surface 325. As shown in FIG. 4A, once the first sizer 300 is attached to the hanger 100, the inner surface 323 of the second inwardly extending finger 322 is capable of engaging the side surface of the fixed latch 210 and the second sloped surface 325 of the second inwardly sloped projection 324 is capable of engaging the sloped surface of the fixed latch 210.

The first sizer 300, as described above, can be readily attached to the hanger 100 in a secured manner. The secured attachment of the first sizer 300 to the hanger 100 satisfies the relevant industry requirements to provide a so-called "child-proof" product, which is preferred or required in the hanger-molding industry. In addition, the details of the first sizer 300, the "child-proof" attachment of the first sizer 300 to the hanger 100, and the optional removal of the first sizer 300 from the hanger 100 can be found in Applicant's commonly owned U.S. Pat. No. 6,264,075, the entire disclosure of which is incorporated into the present discourse for all purposes.

Figure 5:
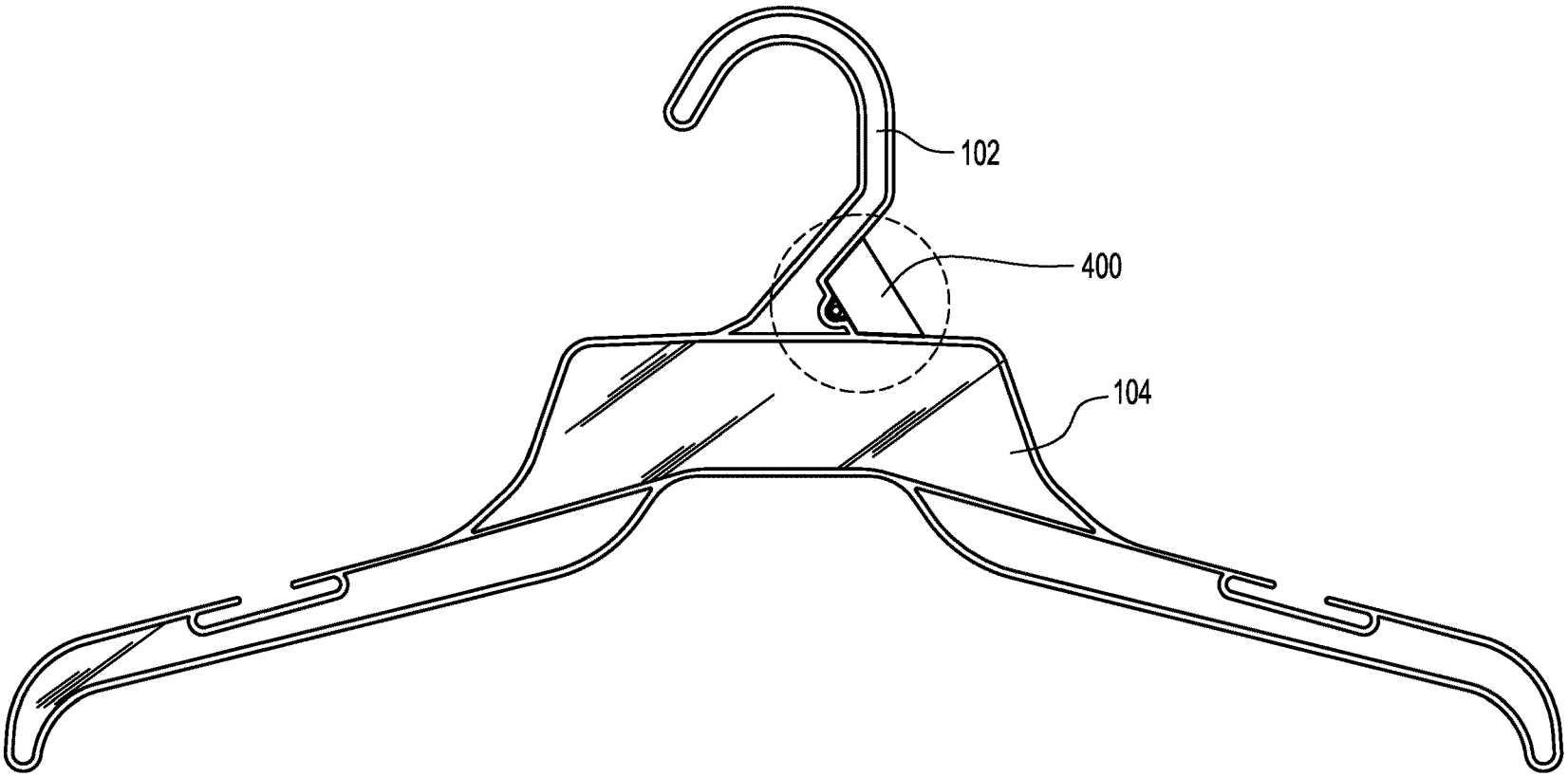
FIG. 5 is a front elevation view of the garment hanger of FIG. 1 in combination with a second sizer, according to yet another exemplary embodiment of the present disclosure.

FIG. 5 depicts a combination of the hanger 100 with a second sizer 400 when the sizer 400 is attached to the hanger 100. The second sizer 400 is larger than the first sizer 300. FIG. 6 is an enlarged view of the lower neck region of FIG. 5. As shown in FIG. 6, the second sizer 400 is attached to the sizer attachment mechanism 200, while at least partially covering the void 204.

Figure 7:
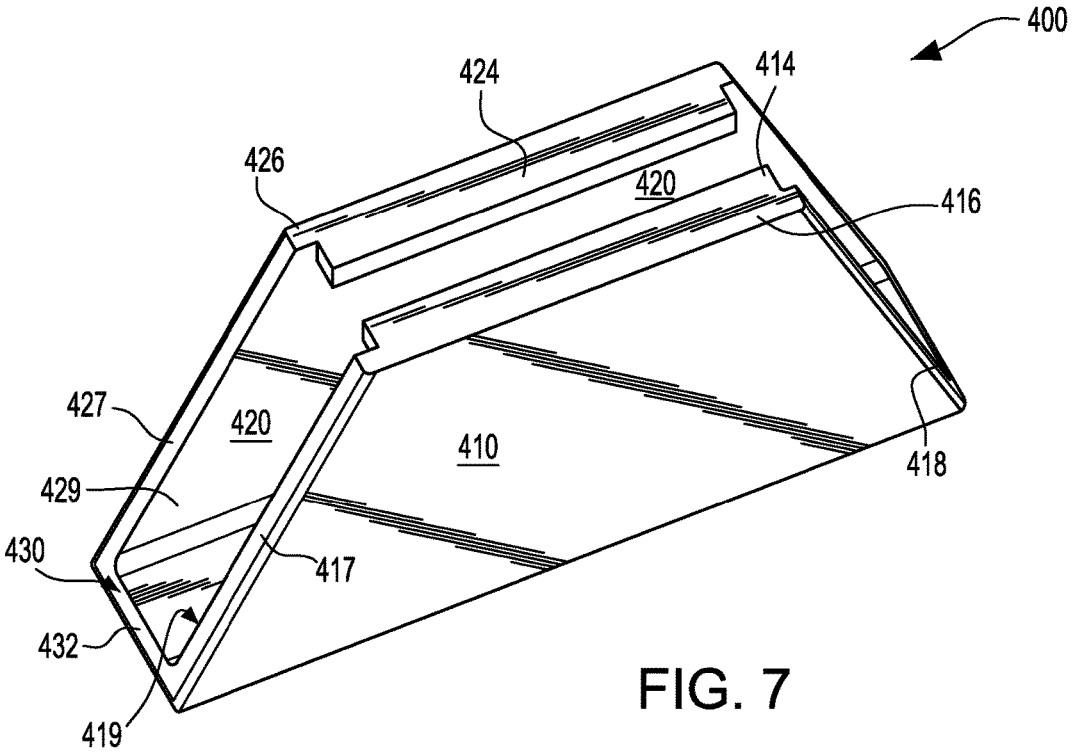
FIGS. 7 and 8 are perspective views of the second sizer.
Figure 8:
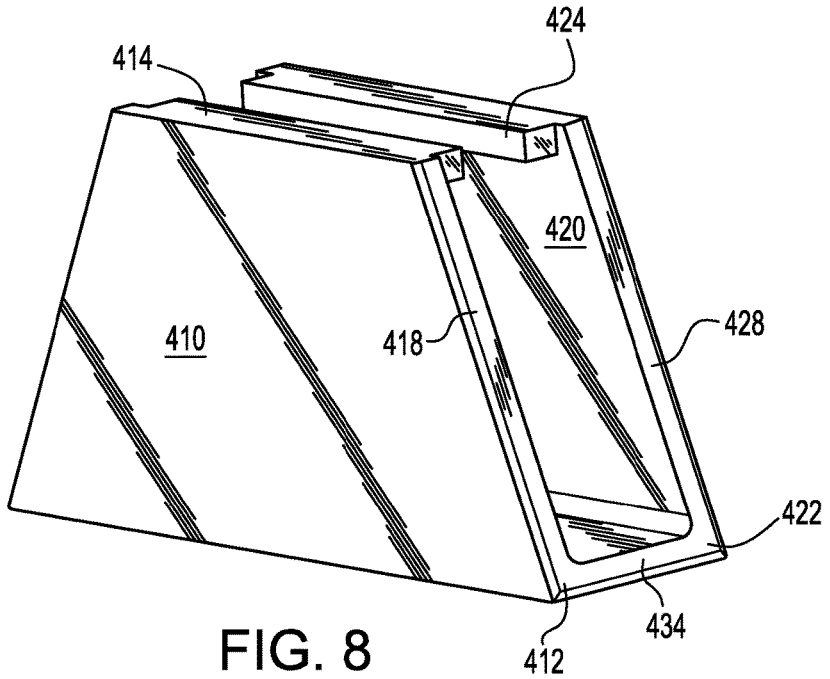

FIGS. 7 and 8 are perspective views of the sizer 400. The sizer 400 includes a front wall 410, a rear wall 420 opposite the front wall 410, and a bottom wall 430 connecting the lower edge 412 of the first wall 410 and the lower edge 422 of the second wall 420. The front wall 410 and the rear wall 420 are substantially trapezoidal. The external surfaces of the front wall 410, the rear wall 420 and the bottom wall 430 can be printed with the information related to the garment products, particularly, sizes of the garments. The sizer 400 further includes a first inwardly extending protrusion 414 provided at the top edge 416 of the front wall 410. The sizer 400 further includes a second inwardly extending protrusion 424 provided at the top edge 426 of the rear wall 420. Both the first protrusion 414 and the second protrusion 424 can extend substantially along the entire length of the top edge 416 and the top edge 426, respectively.

Both the first protrusion 414 and the second protrusion 424 can be made of a resilient material to allow certain deformation of the protrusions. The front wall 410, the rear wall 420 and the bottom wall 430 can be made of a resilient material, such that certain deformation of the sizer is allowed in addition to the deformation of the protrusions. An opening 440 defined between the first protrusion 414 and the second protrusion 424 can be expanded, when the sizer 400 is deformed, to admit certain structures of the sizer attachment mechanism 200.

As shown in FIG. 7, the front wall 410 has a first side surface 417, the rear wall 420 has a first side surface 427 and the bottom wall 430 has a first side surface 432. As shown in FIG. 8, the front wall 410 has a second side surface 418, the rear wall 420 has a second side surface 428 and the bottom wall 430 has a second side surface 434.

The first side surface 417, the first side surface 427 and the first side surface 432 can be formed to substantially co-planar, such that when the second sizer 400 is attached to the hanger 100, the first side surfaces of the sizer 400 can engage the top flange 128 of the hanger body 120, as shown in FIG. 6. The second side surface 418, the second side surface 428 and the second side surface 434 can be formed to substantially co-planar, such that when the second sizer 400 is attached to the hanger 100, the second side surfaces of the sizer 400 can engage the flange 112 of the hook 110. As a result, the vertical movement of the second sizer 400 (along the Z direction of the coordinate system of FIG. 1) can be prevented.

FIG. 6A depicts a sectional view of the combination of the second sizer 400 and the hanger 100, along lines 6A-6A of FIG. 6. As shown in FIG. 6A, when the second sizer 400 is attached to the sizer attachment mechanism 200 of the hanger 100, the first protrusion 414 operatively engage the pivotable latch 220 to be subsequently placed or engaged between the pivotable latch 220 and the guard 230 (which is at the front side of the hanger 100). At the same time, the second protrusion 424 operatively engages the fixed latches 210 to be subsequently placed or sandwiched between the fixed latches 210 and the guard 230 (which is at the rear side of the hanger 100). As a result, the side to side movement of the second sizer 400 (along the X direction of the coordinate system of FIG. 1) can be prevented.

As shown in FIG. 6A, the front wall 410 has an inner surface 419 and the rear wall 420 has an inner surface 429 that is opposite the inner surface 419. Both the inner surface 419 and the inner surface 429 can operatively engage the front surface and the rear surface of the angularly extending rib 203. As a result, the front and rear movement of the second sizer 400 (along the Y direction of the coordinate system of FIG. 1) can be prevented.

The second sizer 400, as described above, can be readily attached to the hanger 100 in a secured manner. The secured attachment of the second sizer 400 to the hanger 100 satisfies the relevant industry requirements to provide a so-called "child-proof" product, which is preferred or required in the hanger-molding industry. In addition, the user has the option to selectively attach the second sizer 400 directly to the hanger 100, without having to attach and detach the first sizer 300.

Figure 9:
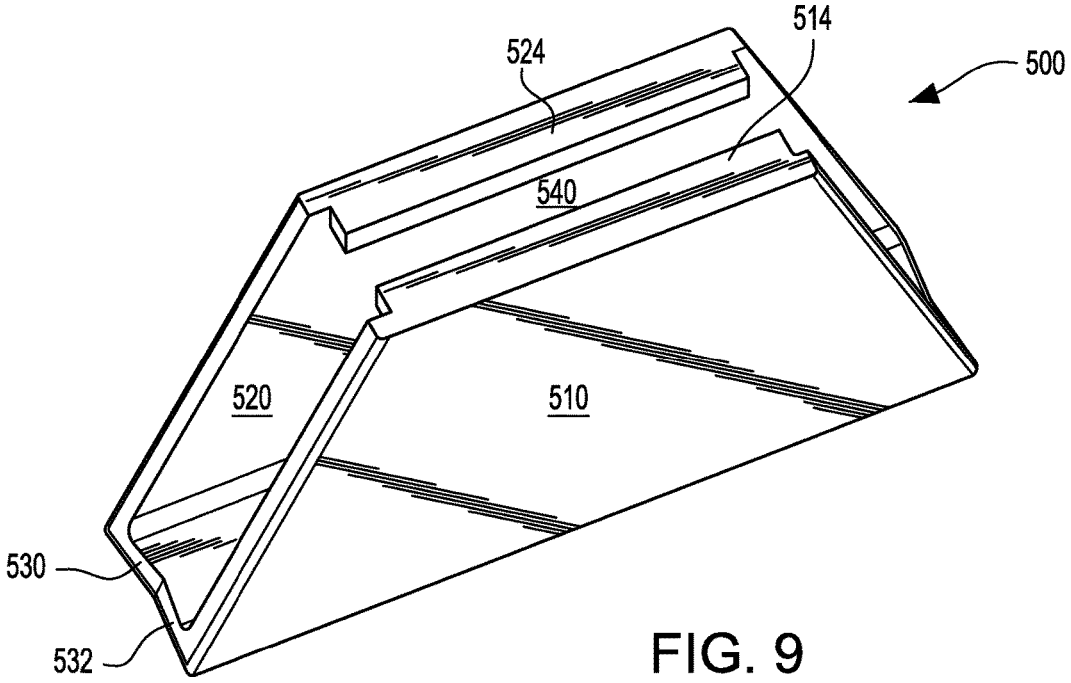
FIGS. 9 and 10 are perspective views of another embodiment of the second sizer.
Figure 10:
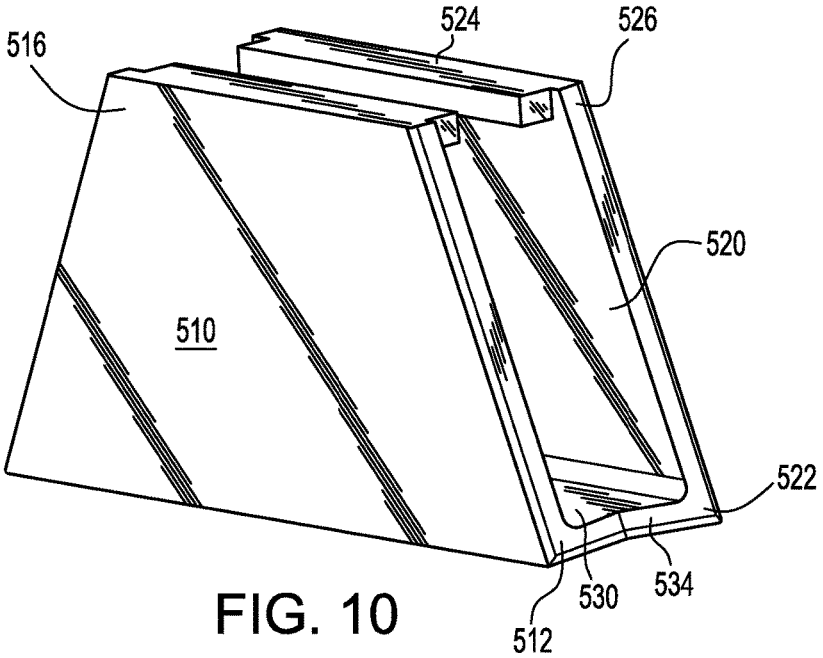

FIGS. 9 and 10 are perspective views of a second sizer 500, according to another embodiment of the present disclosure. The second sizer 500 includes a front wall 510, a rear wall 520 opposite the front wall 510, and a bottom wall 530 connecting the lower edge 512 of the first wall 510 and the lower edge 522 of the second wall 520. The front wall 510 and the rear wall 520 are substantially trapezoidal. The external surfaces of the front wall 510, the rear wall 520 and the bottom wall 530 can be printed with the information related to the garment products, particularly, sizes of the garments. The sizer 500 further includes a first inwardly extending protrusion 514 provided at the top edge 516 of the front wall 510. The sizer 500 further includes a second inwardly extending protrusion 524 provided at the top edge 526 of the rear wall 520. Both the first protrusion 514 and the second protrusion 424 can extend substantially along the entire length of the top edge 516 and the top edge 526, respectively. The bottom wall 530 has first side surfaces 532 and a second side surface 534, which are non-planar. The engagement of the sizer 500 to the hanger 100 is the same as the engagement of sizer 400 to the hanger 100.

The second sizer 500, as described above, can be readily attached to the hanger 100 in a secured manner. The secured attachment of the second sizer 500 to the hanger 100 satisfies the relevant industry requirements to provide a so-called "child-proof" product, which is preferred or required in the hanger-molding industry.

Another exemplary aspect of the present disclosure includes a methodology of strategically using the hanger 100 (having the sizer attachment mechanism 200, the sizer attachment mechanism 200', or the sizer attachment mechanism 200") with the first sizer 300 and/or the second sizer 400/500 depending on the various circumstances of application, thereby achieving certain technological, logistical and economical advantages and benefits not provided by the known hangers and sizers.

One embodiment of the methodology is directed to using the hanger 100, having the sizer attachment mechanism 200, with the first sizer 300 and subsequently, with the second sizer 400/500, or vice versa, to allow the same hanger to be reusable with the same sizer or different sizers. According to this embodiment, the first sizer 300 is initially attached to the sizer attachment mechanism 200 of the hanger 100 for displaying a first garment identified by the first sizer 300. The first sizer 300 is subsequently removable by applying a sizer releasing force to the dimple 226 of the sizer attachment mechanism 200. Once the first sizer 300 is removed, the second sizer 400/500 can be attached to the sizer attachment mechanism 200 of the hanger 100 for displaying a garment identified by the second sizer 400/500.

Optionally, the second sizer 400/500 can also be removed by applying a sizer releasing force to the dimple 226 and, subsequently a first sizer 300 can be attached to the sizer attachment mechanism 200 of the hanger 100. Thus, pursuant to this embodiment, a so-called reusable hanger with sizer-detaching mechanism is provided, which allows replacing the first sizer 300 with the second sizer 400/500 or vice versa. In each of these cases, the sizer can be removed and replaced with a same or different sizer. The versatility of the hanger improves the product design to save materials and energy and, concomitantly, reduce the manufacturing costs. In the hanger molding industry, millions of plastic hangers are manufactured each year. The reusable hanger, as shown and described above, is considered environmentally friendly and provides a commercial advantage to the manufacturers, transporters and retailers in the industry.

Another embodiment of the methodology is directed to using the hanger 100, having the sizer attachment mechanism 200' or 200", alternatively and independently with the first sizer 300 or the second sizer 400/500 in a substantially un-detachable manner. The sizer attachment mechanism 200' or 200" does not have a structure for applying a sizer releasing force. Thus, once a sizer is attached to the hanger 100, the sizer cannot be readily removed.

The hanger 100, as shown and described above, can be used selectively with the first sizer 300 and the second sizer 400 (or the second sizer 500) having different dimensions, depending on the circumstances of applying the sizers. Thus, a so-called reusable hanger can be provided. The versatility of the hanger improves the product design to save materials and energy and, concomitantly, reduce the manufacturing costs. In the hanger molding industry, millions of plastic hangers are manufactured each year. The reusable hanger, as shown and described above, is considered environmentally friendly and provides a commercial advantage to the manufacturers, transporters and retailers in the industry.

Furthermore, regardless of which sizer a user has selected to be used with the hanger, only one hanger type needs to be molded. As known in the hanger-molding industry, whenever a new mold needs to be created for making a new type of hanger, significant cost associated with designing, testing and modifying the mold will be incurred. Thus, the ability to use a same mold to mold hangers, which can be used with two different sizers, significantly reduces the cost associated with designing, testing and modifying a new mold.

In addition, in the industry, it is common for a retailer to offer different types of garments, which are placed and displayed in different departments of a shopping center, respectively. Thus, the hanger as described above provides the retailer an option to use different sizers with the same hangers in different departments.

The hanger of the present disclosure can be formed of one or more of polystyrene, SAN, ABS, PPO, nylon, polypropylene (PP), polyethylene, PET, polycarbonates (PC), acrylics, K-resin, and polyvinyl chloride (PVC) among others.

From the foregoing illustrations it is readily apparent that the present disclosure is directed to an improved garment hanger suitable for industry mass production. The present disclosure offers reliable mechanical performance and structural integrity to the hangers, satisfying industry standards, such as, the VICS standards.

We claim:

1. A garment hanger comprising:

a body and a hook extending upright from the body, wherein the intersection of the body and the hook defines a lower neck region of the garment hanger; and a sizer attachment mechanism provided at a side of the lower neck region, wherein the sizer attachment mechanism is configured to engage a sizer for selectively attaching and detaching the sizer with respect to the hanger;

wherein the sizer attachment mechanism comprises:

a first web having a first surface and an opposite second surface, wherein the first web comprises:

at least one fixed latch formed on the first surface of the first web, and a pivotable latch pivotable with respect to the at least one fixed latch through a hinge;

a second web connected to the first web;

a rib connected to the second web, wherein the rib extends angularly between the body and the hook; and a void in the sizer attachment mechanism to provide a discontinuity in the second web and the rib.

2. The garment hanger according to claim 1, wherein the sizer attachment mechanism further comprises a slot formed through the first web for defining the pivotable latch.

3. The garment hanger according to claim 2, wherein the slot and the hinge together define a substantially triangle shape of the pivotable latch.

4. The garment hanger according to claim 3, wherein the sizer attachment mechanism further comprises a dimple provided at a tip of the pivotable latch, wherein the dimple is engageable by a tool to apply a releasing force to detach the sizer from the hanger.

5. The garment hanger according to claim 4, wherein the dimple is removed, such that application of a releasing force to detach the sizer from the hanger is prevented.

6. The garment hanger according to claim 1, wherein the sizer attachment mechanism is further configured to alternatively engage a second sizer after the sizer is detached from the hanger, wherein the second sizer has a dimension that is different from a dimension of the sizer.

7. The garment hanger according to claim 1, wherein the first web and the second web are formed integrally and continuous with each other.

8. A combination of a garment hanger and a sizer, wherein the garment hanger comprises:

a body and a hook extending upright from the body, wherein the intersection of the body and the hook defines a lower neck region of the garment hanger; and a sizer attachment mechanism provided at a side of the lower neck region, wherein the sizer attachment mechanism is configured to engage the sizer for selectively attaching and detaching the sizer with respect to the hanger;

wherein the sizer attachment mechanism comprises:

a first web having a first surface and an opposite second surface, wherein the first web comprises:

at least one fixed latch formed on the first surface of the first web, and a pivotable latch pivotable with respect to the at least one fixed latch through a hinge;

a second web connected to the first web;

a rib connected to the second web, wherein the rib extends angularly between the body and the hook; and a void to provide a discontinuity in the second web and the rib, wherein the sizer comprises:

a front wall having a top edge and a bottom edge;

a rear wall opposite the front wall, wherein the rear wall has a top edge and a bottom edge, wherein both the front wall and the rear wall are substantially trapezoidal;

a bottom wall connecting the bottom edge of the front wall with the bottom edge of the rear wall;

a first inwardly extending protrusion provided at the top edge of the front wall; and a second inwardly extending protrusion provided at the top edge of the rear wall, wherein, when the sizer is being attached to the hanger, the first inwardly extending protrusion is engageable with the at least one fixed latch and the second inwardly extending protrusion is engageable with the pivotable latch to implement a secured attachment of the sizer to the hanger, and wherein, when the sizer is not attached to the hanger, the void allows a secondary sizer to be removably engageable with the first web of the sizer attachment mechanism to attach the secondary sizer to the hanger.

9. The combination according to claim 8, wherein the sizer attachment mechanism further comprises a continuous slot formed through the first web.

10. The combination according to claim 9, wherein the continuous slot and the hinge together define a substantially triangle shape of the pivotable latch.

11. The combination according to claim 10, wherein the sizer attachment mechanism further comprises a dimple provided at a tip of the pivotable latch, wherein the dimple is engageable by a tool to apply a releasing force to detach the sizer or the secondary sizer from the hanger.

12. The combination according to claim 10, wherein, when the sizer is being attached to the hanger, an inner surface of the bottom wall of the sizer engages the rib of the sizer attachment mechanism, such that movement of the sizer with respect to the body can be prevented to prevent inadvertent dislodgement of the sizer.

13. A method of using a hanger with a first sizer and reusing the hanger with a second sizer, wherein the first sizer has a dimension that is different from a dimension of the second sizer, the method comprising:

attaching the first sizer to a sizer attachment mechanism of the hanger, wherein the sizer attachment mechanism comprises:

a first web having a first surface and an opposite second surface, wherein the first web comprises:

at least one fixed latch formed on the first surface of the first web, and a pivotable latch pivotable with respect to the at least one fixed latch through a hinge;

a second web connected to the first web;

a rib connected to the second web, wherein the rib extends angularly between a body and a hook of the hanger; and a void in the sizer attachment mechanism to provide a discontinuity in the second web and the rib, wherein the attaching the first sizer to the sizer attachment mechanism comprises engaging the first sizer with both the at least one fixed latch and the pivotable latch and at least partially positioning the first sizer in the void;

detaching the first sizer from the sizer attachment mechanism; and attaching the second sizer to the sizer attachment mechanism, wherein the attaching the second sizer to the sizer attachment mechanism comprises engaging the second sizer with both the at least one fixed latch and the pivotable latch and covering the void with the second sizer.

14. The method according to claim 13, wherein the detaching the first sizer from the sizer attachment mechanism comprises applying a sizer-releasing force to a dimple provided at a tip of the pivotable latch.

15. The method according to claim 14, further comprising detaching the second sizer from the sizer attachment mechanism.

16. The method according to claim 15, wherein the detaching the second sizer from the sizer attachment mechanism comprises applying a sizer releasing force to the dimple.

17. The method according to claim 13, wherein the second sizer comprises a first inwardly extending protrusion and an opposite second inwardly extending protrusion, and wherein the attaching the second sizer to the sizer attachment mechanism comprises engaging the first inwardly extending protrusion with the at least one fixed latch and engaging the second inwardly extending protrusion with the pivotable latch.

18. The method according to claim 17, wherein the attaching the second sizer to the sizer attachment mechanism further comprises engaging an inner surface of a bottom wall of the second sizer with the rib, such that any lateral movement of second sizer is prevented by the engagement between the rib and the inner surface and the engagement between first and second inwardly extending protrusions and the fixed and pivotable latches, respectively.

19. A garment hanger comprising:

a body and a hook extending upright from the body, wherein the intersection of the body and the hook defines a lower neck region of the garment hanger; and a sizer attachment mechanism provided at a side of the lower neck region, wherein the sizer attachment mechanism is configured to alternatively engage a first sizer or a second sizer for attaching the first sizer or the second sizer to the hanger in an un-detachable manner;

wherein the sizer attachment mechanism comprises:

a first web having a first surface and an opposite second surface, wherein the first web comprises:

at least one fixed latch formed on the first surface of the first web, and a pivotable latch pivotable with respect to the at least one fixed latch;

a second web connected to the first web;

a rib connected to the second web, wherein the rib extends angularly between the body and the hook; and a void in the sizer attachment mechanism to provide a discontinuity in the second web and the rib.

20. The garment hanger according to claim 19, wherein the sizer attachment mechanism is configured to prevent application of a releasing force to detach the attached sizer from the hanger.

21. A garment hanger comprising:

a body and a hook extending upright from the body, wherein the intersection of the body and the hook defines a lower neck region of the garment hanger; and a sizer attachment mechanism provided at a side of the lower neck region, wherein the sizer attachment mechanism is configured to alternatively engage a first sizer or a second sizer for attaching the first or second sizer to the hanger in an un-detachable manner, wherein the first sizer has a dimension that is different;

wherein the sizer attachment mechanism comprises:

a first web having a first surface and an opposite second surface, wherein the first web comprises:

a first fixed latch formed on the first surface of the first web, and a second fixed latch formed on the second surface of the first web;

a second web connected to the first web;

a rib connected to the second web, wherein the rib extends angularly between the body and the hook; and a void in the sizer attachment mechanism to provide a discontinuity in the second web and the rib.

22. The garment hanger according to claim 21, wherein the sizer attachment mechanism is configured to prevent application of a releasing force to detach the attached sizer from the hanger.

23. A method of using a hanger selectively with a first sizer and a second sizer, wherein the first sizer has a dimension that is different from a dimension of the second sizer, the method comprising:

selecting a sizer from the first sizer and the second sizer to be attached to the hanger;

attaching the selected sizer to a sizer attachment mechanism of the hanger, wherein the sizer attachment mechanism comprises:

a first web having a first surface and an opposite second surface, wherein the first web comprises:

a first fixed latch formed on the first surface of the first web, and a second fixed latch formed on the second surface of the first web;

a second web connected to the first web;

a rib connected to the second web, wherein the rib extends angularly between a body and a hook of the hanger; and a void in the sizer attachment mechanism to provide a discontinuity in the second web and the rib, wherein the attaching the selected sizer to the sizer attachment mechanism of the hanger comprises engaging the selected sizer with both the first fixed latch and the second fixed latch in a un-detachable manner.

24. The method according to claim 23, wherein the selecting the sizer from the first sizer and the second sizer to be attached to the hanger comprises selecting the sizer based on a determination of a location within a shopping center where the hanger is used for showing garments.

* * * * *